United States Patent [19]

McCullough

[11] Patent Number: 4,472,120

[45] Date of Patent: Sep. 18, 1984

[54] SCROLL TYPE FLUID DISPLACEMENT APPARATUS

[75] Inventor: John E. McCullough, Carlisle, Mass.

[73] Assignee: Arthur D. Little, Inc., Cambridge, Mass.

[21] Appl. No.: 398,479

[22] Filed: Jul. 15, 1982

[51] Int. Cl.[3] ..... F01C 1/02; F01C 21/06; F01C 21/08; F04C 29/04

[52] U.S. Cl. ..... 418/55; 418/83; 418/100; 418/151

[58] Field of Search ..... 418/55, 57, 83, 100, 418/151

[56] References Cited

U.S. PATENT DOCUMENTS

| | | | |
|---|---|---|---|
| 3,473,728 | 10/1969 | Vulliez | 418/55 |
| 3,797,972 | 3/1974 | Nakayama et al. | 418/100 |
| 3,874,827 | 4/1975 | Young | 418/55 |
| 3,884,599 | 5/1975 | Young et al. | 418/55 |
| 4,082,484 | 4/1978 | McCullough | 418/55 |
| 4,089,625 | 5/1978 | Hofmann, Jr. | 418/83 |
| 4,178,143 | 12/1979 | Thelen et al. | 418/55 |
| 4,259,043 | 3/1981 | Hidden et al. | 418/55 |
| 4,350,479 | 9/1982 | Tojo et al. | 418/55 |
| 4,382,754 | 5/1983 | Shaffer et al. | 418/55 |

FOREIGN PATENT DOCUMENTS

| | | | |
|---|---|---|---|
| 261526 | 11/1928 | Italy | 418/151 |
| 57-28890 | 2/1982 | Japan . | |
| 57-76290 | 5/1982 | Japan | 418/55 |

*Primary Examiner*—John J. Vrablik

*Attorney, Agent, or Firm*—Richard J. Hammond

[57] ABSTRACT

A scroll type fluid displacement apparatus, for example a refrigerant compressor, includes reinforcing ribs on the rear side of the base plate of the orbiting scroll element to provide rigidity to the base plate. Central and peripheral thrust bearings behind the base plate provide axial restraint for the orbiting scroll element, and one of the thrust bearings is arranged to maintain the fixed and orbital wrap in predetermined angular relationship. A swirling system for the fluid inlet into the scroll apparatus separates liquid from gas in the incoming fluid before it reaches the involute scroll wraps, and the tip edges of the scroll wraps are preformed so that the tip of each scroll wrap tends to expand under exposure to a differential thermal gradient between its inner and outer region to maintain a uniform tip clearance across its entire diameter under operating conditions.

16 Claims, 6 Drawing Figures

SCROLL TYPE FLUID DISPLACEMENT APPARATUS

BACKGROUND OF THE INVENTION

1. Field of the Invention

This invention relates to scroll type fluid displacement apparatus, and has particular application in scroll type compressor systems.

2. Description of Prior Art

Scroll type fluid displacement systems, including pumps, compressors and expanders, have become generally well-known and are extensively described in patent and technical literature. A rather extensive discussion, for example, of such prior art relating to such devices is seen in U.S. Pat. No. 3,884,599, which patent also describes the operating principle of scroll fluid displacement systems. Other patents can be seen which disclose other improvements in scroll devices. One example of the latter is U.S. Pat. No. 4,082,484 which describes a drive shaft arrangement for a scroll fluid displacement device, the drive shaft having a fixed crank connected to the orbiting scroll and a counterweight for dynamically balancing the eccentric loads imposed by the orbiting scroll apparatus. Another patent, U.S. Pat. No. 4,259,043, describes a combined thrust bearing/coupling for maintaining a predetermined angular relationship between an orbiting and fixed scroll wrap of a scroll type fluid displacement system. Numerous other patents could be mentioned along these lines, but the foregoing patents have particular relevancy insofar as the inventive concept herein presented is concerned.

As regards the present invention, a problem yet to be solved in scroll devices is how to reduce the mass of the orbiting structure while still strictly maintaining axial tip clearances between the wraps. Since reducing the mass of the orbiting wrap, for example, as well as of its supporting base plate, normally results in a less rigid structure, axial bending loads imposed on the base plate can result in their deformation with the consequent axial displacement of the involute wraps which produces tip sealing and leakage problems. It has been observed that axial restraint against such displacement is desirable, particularly in the central region of the orbiting wrap assembly when the device in question is a compressor having a central fluid outlet, since higher pressures are encountered in the outlet region of the wraps as opposed to the outer areas which are arranged to intake pumped fluid. This is not to say that the outer area of the base plate carrying the orbiting wrap can be ignored in terms of axial restraint, since a sealing ring cooperating with the base plate is normally provided at the peripheral area of the latter to isolate the intake chamber or area of the compressor from the remainder of the housing containing the orbiting wrap assembly. Indeed, an axial restraint arrangement along these lines is shown in the above-mentioned U.S. Pat. No. 4,082,484 which relates to a scroll compressor and describes an axial restraint including a centrally located thrust bearing and a peripherally located anti-rotation Oldham-type coupling. However, the orbiting plate constructed in accordance with such prior art teachings was usually designed to be rather rigid in an axial sense whereby the central thrust bearing was able to react virtually all of the axial loadings between the orbiting base plate and the drive shaft, while the peripheral coupling, which did not include any bearing elements in the conventional sense, essentially performed the function of maintaining the orbiting wrap in predetermined angular relationship with the stationary wrap. Thus, there still remained the problem of axially restraining a lightweight, less rigid base plate and orbiting wrap assembly against axial displacement across its full diameter, without incurring excessive friction and wear problems and while maintaining the system within a compact outer envelope. The present invention is intended to solve this problem.

Yet another problem encountered with prior art scroll fluid displacement devices operating as compressors, particularly where the compressor must work with inlet fluids comprising a mixture of gas and liquid phase components, (e.g., refrigerant compressors) is to minimize intake of liquid phase fluid into the fluid displacement chamber(s) between the fixed and orbiting wraps. While the prior art generally can be shown to provide numerous illustrations of how such liquid and gas phase components can be separated, none has been noted as providing a simple solution that can be incorporated directly in the inlet of a scroll type fluid compressor. The present invention is intended to provide a solution to such problem.

Still another problem in prior art scroll compressor devices has been the maintenance of uniform scroll tip clearances when the scroll is subjected to thermal gradients between the central and outer areas of the scroll wraps. This problem can be particularly severe when axially longer wraps are used, since the total thermal expansion of such wraps is greater than in the case of shorter wrap lengths. The present invention contemplates a solution to this problem by preforming the wraps to take into account their differential expansion between their inner and outer areas.

This invention furthermore contemplates a refinement to the shape of a counterweight mass commonly provided on drive shafts of orbiting scroll apparatus to dynamically balance the eccentric loads applied by the orbiting scroll system. In prior art devices, there is a tendency for the centers of gravity of the orbiting scroll and the counteweight to be axially offset, creating bending and shear loading in the drive shaft system and other imbalances. The present invention is intended to provide a counterweight that is configured to avoid undue separation of the center of gravity of the orbiting plate and the center of gravity of the counterweight, despite the presence of the reinforcing ribs between the orbiting plate and the counterweight.

BRIEF DESCRIPTION OF THE INVENTION

The present invention contemplates providing a low friction axial restraint for an orbiting scroll base plate in a scroll compressor environment, in combination with reinforcing ribs behind the base plate for stiffening the plate against axial deflection that otherwise would affect tip clearances between the scroll wraps. The axial restraint includes central and peripheral ball or roller thrust bearings, wherein the peripheral thrust bearing also maintains the fixed and orbiting scroll wraps in predetermined fixed angular relationship. The reinforcing ribs behind the orbiting plate preferably are tapered as they project radially outwardly and they terminate short of the periphery of the orbiting base plate to leave an area uninterrupted by the ribs for cooperating with the outer peripheral thrust bearing.

The invention furthermore comprises an annular plenum chamber and fluid inlet arrangement adjacent the outer area of the scroll wraps for causing incoming fluid to be tangentially swirled in the plenum chamber, whereby any liquid phase fluid is centrifugally forced to the outer region of the plenum chamber, while the gas phase is freely and preferentially admitted into the fluid displacement chamber(s) between the wraps. Specifically, in accordance with the present invention, the inlet conduit is tangentially located relative to the plenum chamber to cause the incoming fluid to be swirled around the plenum chamber to centrifugally cause desired separation of liquid and gas phase fluid.

The invention herein presented also includes a counterweight means attached to the drive shaft of the orbiting scroll for dynamically balancing the orbiting system. The counterweight is in the form of a radially extending plate that is inclined towards the orbiting base plate and is disposed in overlying relationship relative to the reinforcing ribs located on the rearward side of the base plate. This arrangement tends to bring the centers of gravity of the orbiting system and the counterweight closer together.

The invention also comprises preforming the stationary and involute wraps so they are progressively axially shorter in their central areas as opposed to their radially outer areas when they are at uniform temperature, whereby, when they are progressively heated in their central areas, they tend to expand to uniform length. This tends to make the tip clearances between the wraps consistent and equal, minimizing leakage and sealing problems in the tip areas of the wraps. Thus, a scroll compressor device incorporating the invention can operate at a higher temperature gradient than conventional scroll systems without tip clearance and leakage problems caused by the temperature gradient between the outer area of the wraps and the central area thereof.

DETAILED DESCRIPTION OF PREFERRED EMBODIMENT OF THE INVENTION

Figure 1:
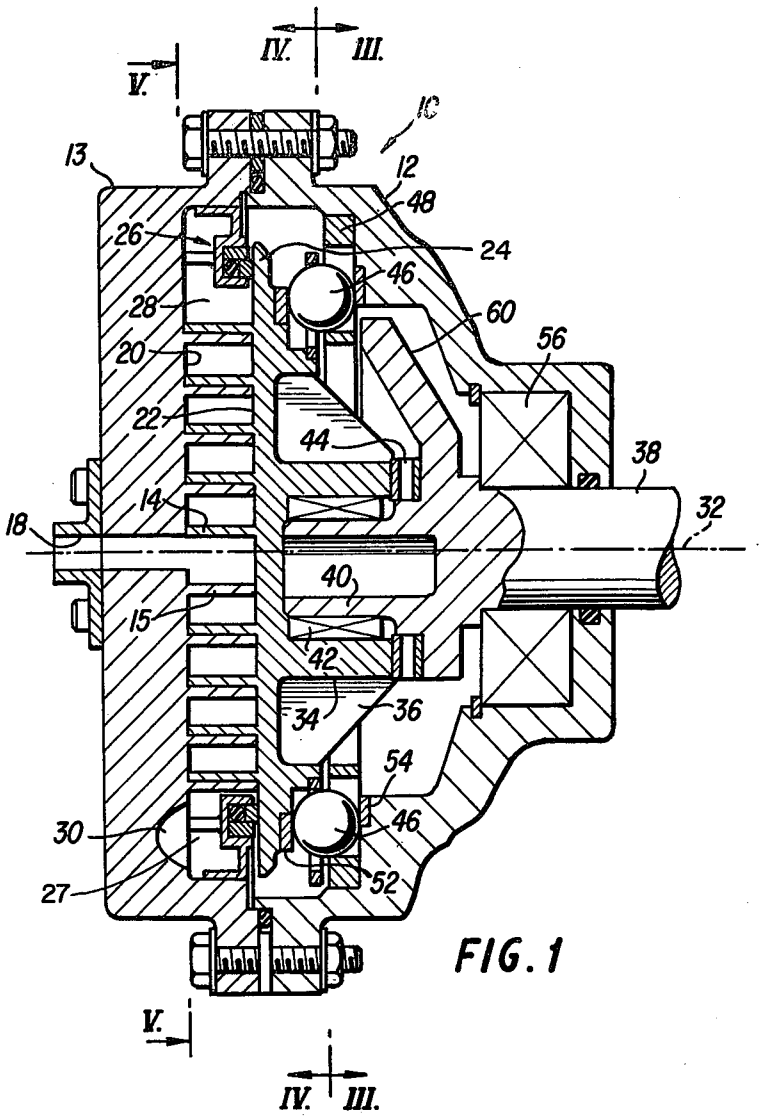
FIG. 1 is a side elevation sectional view of a scroll fluid displacement apparatus including a preferred embodiment of the invention.

With reference to FIG. 1, a scroll type fluid displacement apparatus, in this instance a fluid compressor, includes a housing 10 comprising joined halves 12, 13, the half 13 comprising a cover plate appropriately secured to half 12 by suitable fasteners and with appropriate sealing provisions, all in a manner that may be substantially typical in pump and compressor technology.

Figure 5:
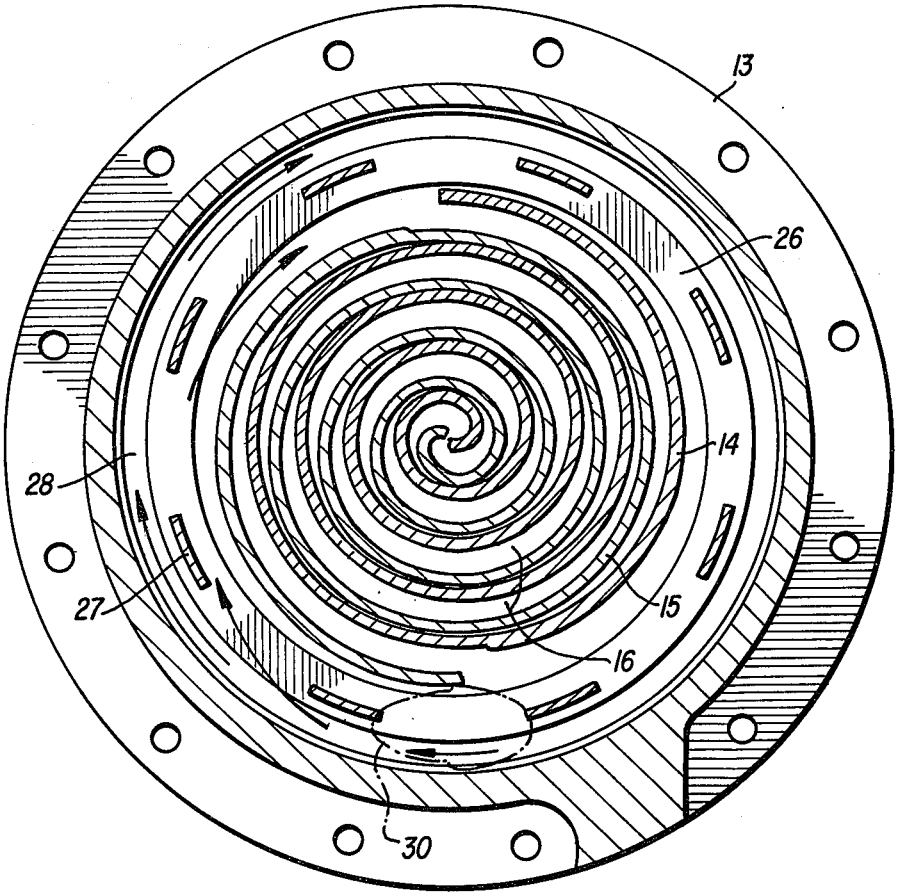
FIG. 5 is a sectional end view taken along line V—V of FIG. 1.

Within housing 10, as best seen in FIG. 5, a pair of involute or arcuate axially extending wraps 14, 15 are operatively meshed in a known manner as described in the patents mentioned in the introductory portion of this specification, whereby orbital motion of the orbiting wrap 14 relative to the fixed wrap 15 effects movement of a fluid displacement chamber(s) 16 between the wraps from the radially outer or peripheral inlet area of the wraps towards the central area thereof, which central area communicates with a fluid outlet 18 (FIG. 1). The fixed wrap 15 in this instance extends axially from a radially extending planar surface 20 of the cover half 13 of the housing, while the orbiting wrap 14 extends axially from a radially extending planar front surface 22 of orbiting base plate 24.

Figure 2:
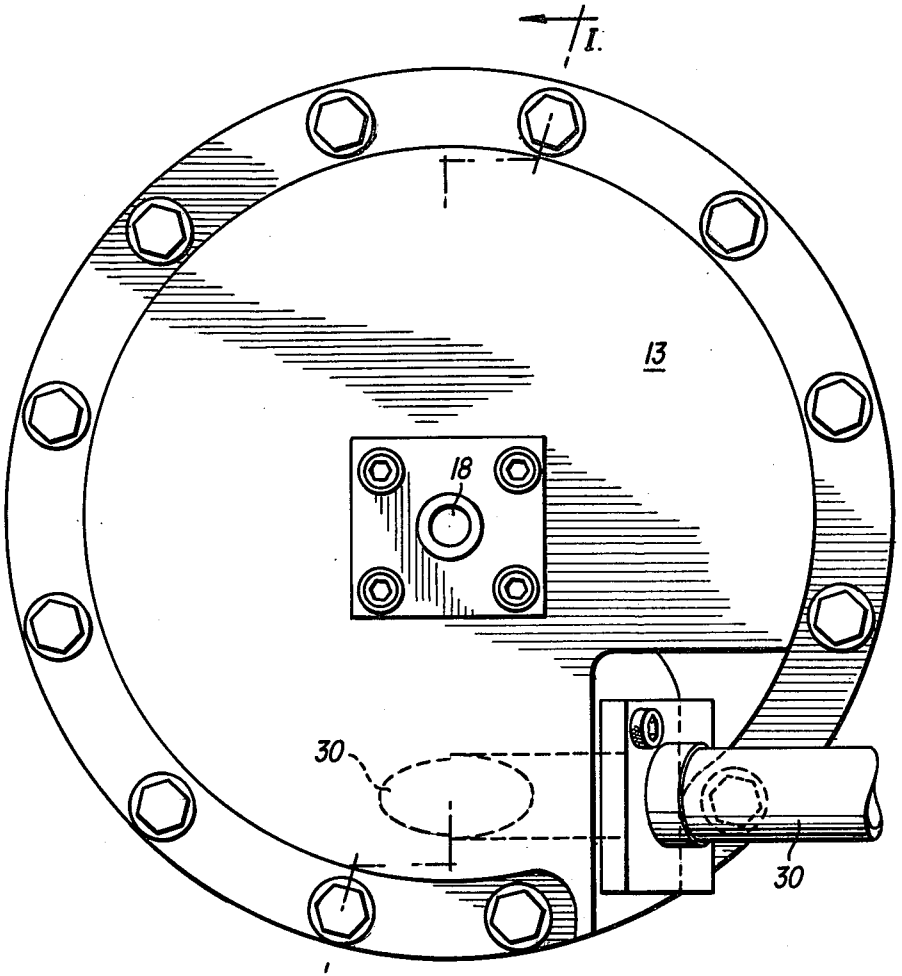
FIG. 2 is an end view of the scroll apparatus of FIG. 1.

A sealing ring arrangement 26 supported on the cover half 13 by struts 27 isolates an annular inlet plenum chamber 28 adjacent the peripheral area of the wraps 14, 15 from the remaining interior of the housing. The inlet conduit 30 (FIG. 2) is tangentially inclined or located relative to the inlet plenum chamber 28 to induce swirling motion in the incoming fluid admitted to the plenum chamber when the system is operational. The swirling motion of the incoming fluid (depicted by arrows in FIG. 5) subjects it to centrifugal force tending to separate incoming liquid phase fluid from gas phase fluid, whereby the gas phase tends to be preferentially received within the fluid displacement chamber(s) 16 during operation of the system, since the plenum chamber is located adjacent the outer periphery of the scroll wraps 14, 15. The swirling motion, moreover, tends to equalize any temperature gradients around the wraps that might otherwise exist. The struts 27 tend to promote the gravitation separation in the plenum chamber 28.

The orbiting base plate 24 includes a rear side opposite the planar surface 22 axially rearwardly of the orbiting wrap 14 along the axis of orbiting motion 32. A central hub area 34 of the base plate is axially thicker than the rest of the plate, and a circumferentially spaced series of radially and axially extending reinforcing ribs 36 provides axial rigidity to the base plate 24. This is an important aspect of the present invention, since it is intended that the base plate 24 be constructed of relatively lightweight materials that can withstand high speed loadings, but might possess less than adequate bending resistance to axial loads.

It will be appreciated that the maintenance of axial sealing between the tips of the wraps 14, 15 requires that the wraps be restricted against axial separation when the pressures between the wraps tend to urge them axially apart. Such a requirement usually necessitates the use of rather rigid and massive support structure for the orbiting wrap to prevent bending of the base plate in its central area under high fluid pressure loads that are imposed in that region. However, the inertia of such massive base plates requires complementary massive drive systems capable of reacting loads encountered at such speeds, and rather massive counterbalancing measures also are required to balance the orbiting eccentric mass of the orbiting wrap about the orbiting axis, both of which characteristics might be undesirable for certain applications.

The present invention overcomes these problems by utilizing a relatively lightweight base plate that in itself can be less rigid than sound design practice would dictate in such scroll apparatus, although ideal from an inertia standpoint, and reinforcing the base plate against axial bending by using axially and radially projecting ribs to increase the bending resistance of the base plate, particularly in its central region. The ribs provide the necessary reinforcement against bending (increased stiffness), while not adding appreciable mass to the orbiting system. The ribs are axially tapered, as seen in FIG. 1, between their radially inner and outer ends to reduce their inertia effect by concentrating their mass where it is more required, and to provide reinforcement near the center area of the base plate. The ribs 36 terminate short of the peripheral area of the base plate, leaving such area free to accommodate a peripheral thrust bearing which will be described in greater particularity below.

The orbiting wrap 14 is driven about a circular path in typical fashion by a drive shaft 38 which terminates just short of the rear of the central hub 34. An offset crank arm 40 connected to the drive shaft engages the interior of the hub 34 through suitable low friction bearings 42 to drive the orbiting wrap about an orbiting radius. It should be understood that the crank arm 40 is only an exempliary illustration of a suitable drive connection between the drive shaft 38 and the base plate 24. Various other arrangements can be envisioned and in fact are disclosed in various prior art patents. It is not intended to limit the present invention to an environment utilizing a fixed throw crank arm such as is illustrated in the drawings, although it constitutes a preferred embodiment of the invention.

A central thrust bearing 44 is provided between the hub 34 and the drive shaft 38 to transmit axial loads between these elements. This thrust bearing is an important part of the invention, since it complements the effect of the reinforcing ribs 34 by providing axial restraint to the base plate 24, which restraint is imposed near the orbiting axis of the orbiting wrap.

In combination with the central thrust bearing 44 there is provided an outer or peripheral thrust bearing 46 located rearwardly of the periphery of the base plate which transmits axial loads between the outer area of the base plate opposite seal ring 26 and suitable fixed structure that reacts such axially loading into the housing. The thrust bearing 46 illustrated here in the preferred embodiment is similar to that described in U.S. Pat. No. 4,259,043 mentioned in the introductory of the specification. The thrust bearing 46, briefly, includes multiple ball rolling elements 46 (at least three ball elements 46 are preferred) that are disposed between a pair of guide rings 48, 50 that respectively are secured to the housing and the orbiting base plate. The guide 50 is secured to the peripheral area of the base plate 24, as seen in FIGS. 1 and 4. The guides 48, 50 have identically shaped, opposed circular openings having centers located on identical circles, and the guides are eccentrically located relative to each other a distance corresponding with the orbiting radius of the orbiting wrap. Rolling ball elements 46 are disposed within the openings of the guides and span the distance between diametrically opposed points on each set of opposed openings. The balls also extend between opposed ball runner surfaces 52, 54 respectively provided on the rear of the base plate 24 and secured to the housing 12, as seen in FIGS. 1, 3 and 4.

Figure 3:
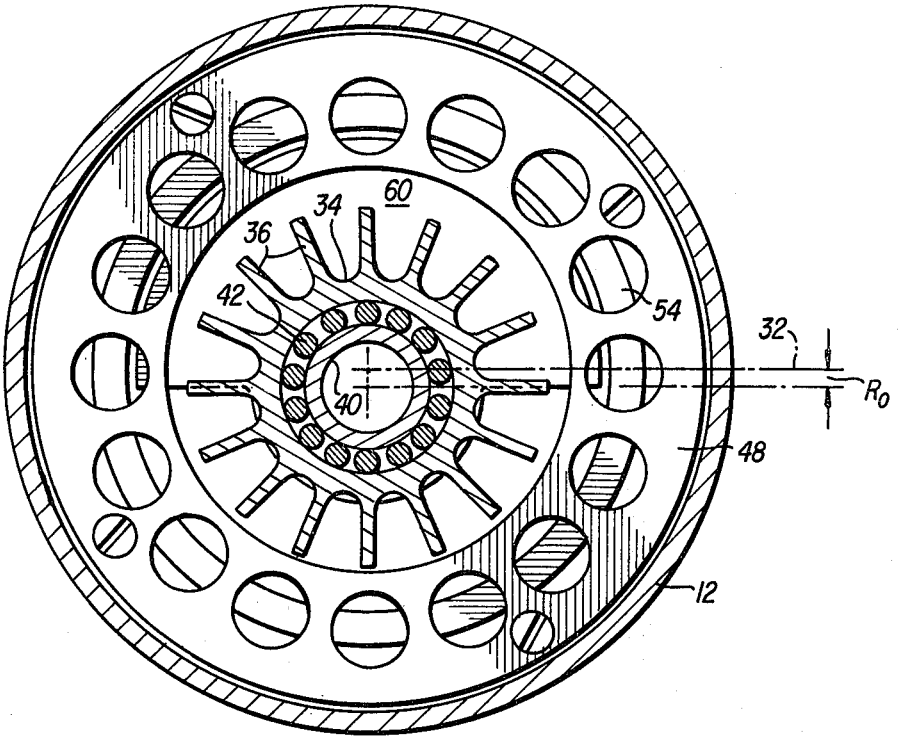
FIG. 3 is a sectional end view taken along line III—III of FIG. 1.
Figure 4:
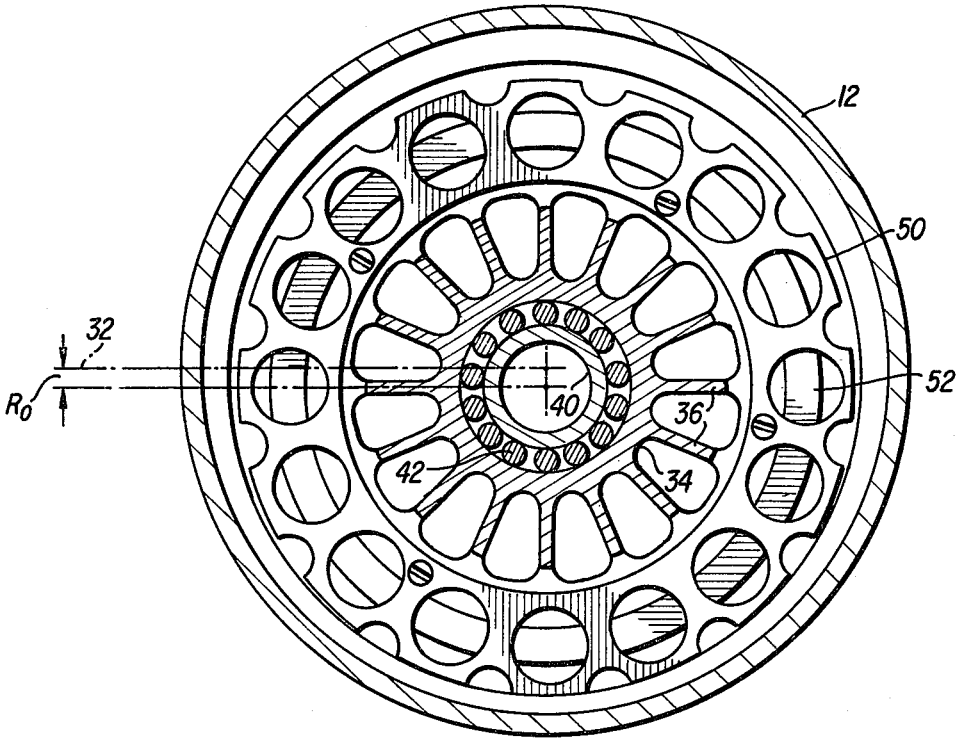
FIG. 4 is a sectional end view taken along line IV—IV of FIG. 1.

The balls are not shown in FIGS. 3 and 4 for the sake of clarity. The thrust bearing ball elements 46 therefore are not only capable of reacting axial thrust loading between the orbiting scroll and fixed housing structure, but they are also arranged within their guides to prevent relative rotation between the orbiting base plate 24 and the housing in the manner of an Oldham coupling. Reference can be made to the aforementioned U.S. Pat. No. 4,259,043 for a more complete description of the combination thrust/coupling bearing 46. It should be apparent, however, that the low friction bearing 46 provides greater advantages over an Oldham-type coupling using sliding surfaces in terms of friction, wear, longevity and precision. More importantly, the combination of a low friction central thrust bearing, which may, for example, comprise rolling needle or ball bearing, with a rolling outer bearing 46 provides a low friction yet axially stiff support configuration for a lightweight orbiting scroll wrap that may be rotated at high speeds and high pressure loading. The outer bearing 46 tends to keep the plane of the orbital base plate in precise axial position in the vicinity of the seal ring 26, which tends to keep the ring in good sealing contact with the front face of the base plate.

The drive shaft 38 itself is axially fixed relative to housing 12 by bearing 56 which supports the shaft for rotation while preventing its axial displacement in the housing.

The eccentric relationship between the orbiting wrap assembly and the center of orbital motion requires a counterweight mass 60 on the drive shaft 38 to achieve dynamic balancing of the movable elements. The use of such counterweights is generally conventional in scroll fluid displacement apparatus, but the specific configuration of the counterweight 60 constructed in accordance with this invention is intended to achieve a unique cooperation between the orbiting base plate and wrap assembly, the reinforcing ribs and the central thrust bearing 44. More specifically, the counterweight 60 is in the shape of a radially extending conical plate that is inclined axially towards the base plate 24 as shown in FIG. 1, so that it passes over the ribs 36 when the drive shaft is rotated. This configuration conserves space within the housing 12 but, more importantly, brings the centers of gravity of the orbiting wrap assembly and the counterweight axially closer together to minimize the transverse moment loads on the crank arm 40 and drive shaft 38 which would normally result when the centers of gravity of the orbiting base plate 24 and the counterweight 60 are axially separated. It will be noted, moreover, that the central hub 34, ribs 36 and outer peripheral bearing 46 all can be intersected by a common imaginary transversely extending plane, such arrangement permitting the apparatus to occupy a space that is axially short in length, a desirable feature in scroll fluid displacement systems that must be compact in terms of outer dimensions.

Figure 6:
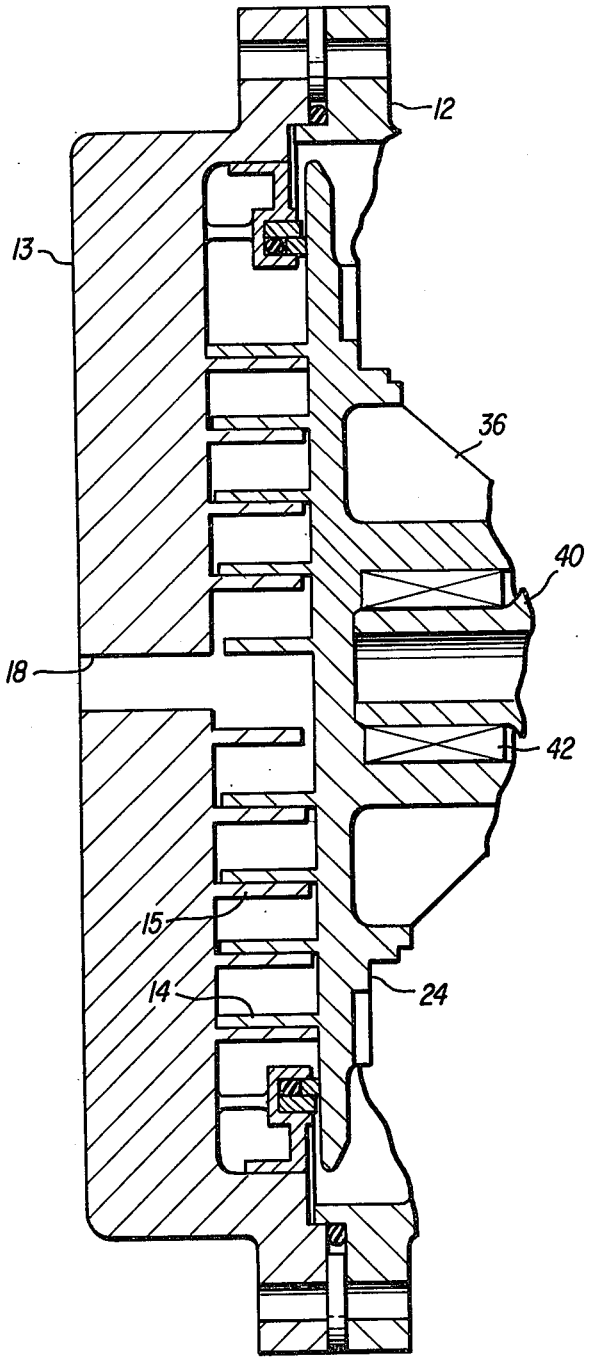
FIG. 6 is a detail view showing scroll wraps configured in accordance with an alternate embodiment of the invention.

In FIG. 6 there is illustrated an alternate embodiment of the invention that takes into account the fact that, in scroll compressor devices, the central area of the wraps is operating at a higher temperature than the radially outer areas of the wraps. While such thermal gradients would not normally cause a problem insofar as tip clearances between the wraps is concerned when the axial length of the wraps is small, it may need to be accounted for when the wraps are longer, due to the fact that they will axially expand to different extents in accordance with the thermal gradient between the inner and outer wrap areas.

Accordingly, as shown in FIG. 6, this invention furthermore contemplates forming the wraps 14, 15 so they are progressively shorter as they approach the central area when they are at uniform temperature, whereby, upon the occurrence of the expected thermal gradient, the inner portions of the wrap progressively axially expand so that the entire wrap lengths approach uniform length between their inner and outer regions. This enables the tip clearance to likewise approach uniformity when the scroll apparatus reaches operating temperatures. Of course, the axial length variation between the wrap inner and outer portions would be carefully selected to produce desired clearances between the wrap tips and their adjacent planar surfaces during operation of the apparatus.

While a preferred embodiment of the invention has been described, it is to be understood that various modifications and refinements to such embodiment could be made without changing the inventive concept itself, which concept is defined in the claims set forth below.

What is claimed is:

1. In scroll type fluid displacement apparatus, including a housing, at least a pair of opposed scroll wraps in operative meshed relationship within the housing to define at least one fluid displacement chamber therebetween; at least one of the wraps extending axially from the forward side of an orbiting base plate, the base plate including a peripheral rear portion and a rearwardly extending, centrally located hub area; and means for driving the base plate about a circular orbital path about an orbiting axis, the improvement comprising:

said base plate including circumferentially spaced reinforcing ribs projecting axially rearwardly from the base plate and extending radially outwardly from said central hub area.

2. The improvement according to claim 1, wherein said ribs are axially shorter at their radially outer ends than at their ends located adjacent the central hub area.

3. The improvement according to claim 2, wherein the lengths of said ribs are uniformly tapered between the central hub area and their radially outer ends.

4. The improvement according to claim 3, wherein the radially outer ends of said ribs terminate short of the circumference of the base plate, leaving a peripheral rear portion of said base plate between the radially outer ends of the ribs and the base plate circumference uninterrupted by ribs.

5. The improvement according to claim 1, further including a peripheral thrust bearing disposed adjacent said peripheral rear portion of the base plate, said thrust bearing arranged to transmit thrust loads from the base plate to the housing and comprising a plurality of low friction rolling elements.

6. The improvement according to claim 5, wherein said peripheral thrust bearing comprises a rotation preventing coupling means for the base plate for maintaining the base plate in predetermined angular relationship with respect to the housing.

7. The improvement according to claim 6, including first runner surfaces attached to the rear portion of said base plate and second runner surfaces attached to said housing, said peripheral thrust bearing comprising at least three circumferentially spaced ball elements spanning said first and second runner surfaces; and means for maintaining said balls in predetermined circumferentially spaced relationship.

8. The improvement according to claim 1, said means for driving said base plate about said orbiting axis including a drive shaft concentric with the orbiting axis, the drive shaft supported for rotation within the housing and otherwise fixed against axial movement relative to the housing; said drive shaft terminating adjacent the base plate central hub area and drivingly connected to said base plate; wherein the improvement further comprises a central low friction thrust bearing means between the central hub area of said base plate and the adjacent drive shaft, said central thrust bearing means arranged to transmit axial loads between the central hub area and said drive shaft.

9. The improvement according to claim 8, including a peripheral thrust bearing between the peripheral rear portion of the base plate and the housing, said peripheral portion bearing arranged to transmit axial loads between the rear peripheral portion of said base plate and the housing, said peripheral thrust bearing including rolling elements.

10. The improvement according to claim 9, said peripheral thrust bearing further including means for maintaining said base plate and housing in a predetermined angular relationship relative to each other.

11. The improvement according to claim 10, wherein said ribs are axially shorter at their radially outer ends than the ends adjacent said central hub area, and are uniformly tapered between their radially inner and outer ends, said central hub area, ribs and rolling elements all intersecting a common, radially extending plane.

12. The improvement according to claim 11, wherein the radially outer ends of said ribs terminate short of the circumference of the base plate, leaving said outer peripheral rear portion of said base plate uninterrupted by said ribs; runner means for said rolling elements secured to said peripheral portion; said rolling elements engaging said runner means.

13. The improvement according to claim 8, including a counterweight means connected to the drive shaft adjacent the central hub area of said base plate, said counterweight means comprising a mass for dynamically balancing the orbiting base plate when the latter is driven by the drive shaft, said mass comprising a generally radially extending plate that is inclined axially away from the drive shaft and axially towards the base plate adjacent the ribs, said ribs being axially tapered between the central hub area and their radially outer ends, said outer ends being axially shorter than the ends adjacent said central hub area, said plate passing over the axially rearward ends of said ribs when the drive shaft is rotated.

14. The improvement according to claim 1, wherein the apparatus comprises a compressor having a fluid outlet at the central area of the opposed wraps, the opposed wraps are substantially equal to each other in axial length, where they intermesh, and are progressively shorter in axial length as they approach the central area of the wraps from the outer portions thereof when the wraps are at a uniform temperature between their central and outer areas, whereby, upon exposure to differential thermal gradients between the central and outer portions, with the central portion heated to a higher temperature than the outer portion, the wraps tend to differentially expand so their central areas are the same length as their radially outer portions.

15. The improvement according to claim 1, wherein said apparatus is a fluid compressor or pump and includes an annular inlet plenum chamber adjacent the outer peripheral area of the wraps, a fluid inlet for the apparatus in communication with said plenum chamber and a fluid outlet in communication with the central area of the wraps, said improvement further comprising, said inlet arranged to admit fluid into said plenum chamber in a generally tangential direction to induce peripheral swirling motion in a fluid supplied to the plenum chamber.

16. In scroll type fluid displacement apparatus including at least a pair of axially opposed involute wraps in operative meshed relationship to define at least one fluid displacement chamber therebetween, said wraps extending axially from substantially parallel planar surfaces, at least one of the wraps being orbitally movable relative to another wrap whereby displacement of any fluid present in said fluid displacement chamber can be effected, the improvement comprising:

each of said wraps being progressively axially shorter as it progresses from its radially outer portion to its central portion when the wrap is at uniform temperature, whereby the axial clearance between each wrap and the opposed planar surface gradually increases from the radially outer portion of the wrap to the central area of the wrap at such uniform temperature, and said clearance tends to become uniform when the central portion of the wrap is heated to a higher temperature than the radially outer portion of the wrap.

* * * * *